US007242275B2

(12) United States Patent
Poniatowski et al.

(10) Patent No.: US 7,242,275 B2
(45) Date of Patent: Jul. 10, 2007

(54) VARIABLE INDUCTOR

(75) Inventors: John E. Poniatowski, Annandale, VA (US); John W. Walkinshaw, Westford, MA (US)

(73) Assignee: Paper Quality Management Associates, Westford, MA (US)

( * ) Notice: Subject to any disclaimer, the term of this patent is extended or adjusted under 35 U.S.C. 154(b) by 0 days.

(21) Appl. No.: 10/772,140

(22) Filed: Feb. 4, 2004

(65) Prior Publication Data

US 2004/0239463 A1 Dec. 2, 2004

Related U.S. Application Data

(60) Provisional application No. 60/445,214, filed on Feb. 5, 2003.

(51) Int. Cl.
*H01F 27/28* (2006.01)

(52) U.S. Cl. ..... 336/226

(58) Field of Classification Search ..... 336/65, 336/83, 173, 178, 212, 214–215
See application file for complete search history.

(56) References Cited

U.S. PATENT DOCUMENTS 3,212,039 A * 10/1965 Kober ..... 336/77
3,686,561 A * 8/1972 Spreadbury ..... 323/308
5,737,203 A * 4/1998 Barrett ..... 363/75
6,317,021 B1 11/2001 Jansen
6,736,904 B2 5/2004 Poniatowski et al.
2002/0121285 A1 9/2002 Poniatowski et al.

OTHER PUBLICATIONS

Medini, D., and Ben-Yaakov, S., "A Current-Controlled Variable-Inductor for High Frequency Resonant Power Circuits", *IEEE*, 219:225, (1994), no date/month.

* cited by examiner

*Primary Examiner*—Tuyen T. Nguyen
(74) *Attorney, Agent, or Firm*—Proskauer Rose, LLP

(57) ABSTRACT

A variable inductor which avoids electrical breakdown of the insulation in the control windings when used in high power applications includes a core formed of a permeable magnetic material, the core having three legs, including a center leg and two outer legs. A main winding element comprising a main conductor is wound around the center leg of the core. A control winding element comprising a control conductor is wound in a figure-eight configuration having a first winding and a second winding around respective outer legs, the winding configuration canceling induced voltages in the first and second windings, wherein a current through the control winding element causes a change in inductance of the main winding element.

18 Claims, 9 Drawing Sheets

VARIABLE INDUCTOR

RELATED APPLICATION

This application claims the benefit of U.S. Provisional Application No. 60/445,214, filed on Feb. 5, 2003, the entire teachings of which are incorporated herein by reference.

BACKGROUND

Variable inductors can be used in many circuit applications, such as resonant circuits which vary the inductance of circuit elements to vary the resonant frequency of the circuit. An example of a resonant circuit system is described in United States Patent Publication 2002/0121285, the entire teachings of which are herein incorporated by reference.

The simplest way to obtain a variable inductor is by mechanical movement of a connector along an inductive element. However, mechanical movement lacks the response time required for real time control. Further, mechanical movement-type variable inductors have a tendency to lock-up magnetically. Therefore, variable inductors have been designed to vary the inductance of a circuit element by means of an electrical signal rather than by mechanical movement.

The saturation effect of magnetic materials can be employed to create a current controlled variable inductor. These type of variable inductors typically have a limited variation range of 1 to 10 and suffer from parasitic effects such as capacitance and voltage across each control winding that limit the quality (Q) factor of the inductor. Additionally, such current controlled variable inductors require very high control currents in the range of 0 to 500 mA.

The inductance of an inductive circuit element is related to the permeability of the magnetic core and the number of turns:

$$L = \mu_o N^2 \frac{A}{l}; \qquad \text{equation 1}$$

where L is the inductance of an inductive circuit element;

$\mu_o$ is the permeability of the magnetic core;

A is the cross-sectional area of the magnetic core;

N is the number of turns of the inductive element; and l is the length of the inductive element.

FIG. 1 illustrates a current controlled variable inductor 10 in which the inductance $L_{20}$ of main winding 20 is controlled by the current (Ic) delivered to outer control windings 22 and 24. Since the center leg 34 is not saturated, the minimum inductance $L_{20}$ is limited by the number of turns (N) and the magnetic permeability of the core material of the center leg 34. The voltage across each control winding 22 and 24 and the parasitic capacitances of control windings 22 and 24 limit the winding ratio and/or the operating frequency. The inductance of the control windings 22 and 24 changes substantially with the control current (Ic).

A magnetic core 30 is shown consisting of a magnetic material which can be saturated, with three legs 32, 34 and 36. The outer legs 32 and 36 have identical control windings 22 and 24 that are connected in series. The magnetic path for main winding 20 includes outer legs 32 and 36, center leg 34 and the connecting portions 40, 42, 44, and 46. If the control current (Ic) through control windings 22 and 24 becomes large enough to saturate the outer legs 32 and 36 of the core 30, the inductance $L_{20}$ of main winding 20 decreases because a portion of the magnetic path for the main winding 20 is saturated. The higher the control current (Ic) is made, the lower the inductance $L_{20}$. However, the center leg 34 will not be saturated due to the control current (Ic). Control windings 22 and 24 are wound and connected such that the magnetic flux ($\Phi_{c1}$, $\Phi_{c2}$) in respective legs 32 and 36 of the core 30 arising from the control current (Ic) through the outer control windings 22 and 24 is equal and points in opposite directions. The opposing magnetic flux ($\Phi_{c1}$, $\Phi_{c2}$) results in cancellation in the center leg 34 of the core 30. The flux cancellation prevents coupling of AC signals between the main winding 20 and the control windings 22 and 24. AC voltage applied across the terminals of main winding 20 induces a voltage in both of the control windings 22 and 24.

The induced voltage is related to the magnetic flux $\Phi_c$ and the number of turns:

$$e(t) = N\frac{d\phi}{dt}; \qquad \text{equation 2}$$

where e(t) is the induced voltage as a function of time;

$\Phi$ is the magnetic flux $$\left(\frac{d\phi}{dt}\right);$$

and

N is the number of turns of the inductive element.

Although the voltages in the control windings 22 and 24 have opposite polarity such that the voltage across the series connection of control windings 22 and 24 have a net zero voltage, the voltage with respect to ground increases with each respective turn of the control windings 22 and 24. That is, the voltage at point B is greater than the voltage at point A.

SUMMARY

Although electrically variable inductors exist and provide a sufficient response time and a Q factor required for real-time control, these variable inductors do not perform as specified under high magnetic flux level operating conditions. These conditions produce a high magnetic flux density in the main winding which induces a voltage in the control windings proportional to the turns ratio between the control windings and the main winding. When used in high power applications, the induced voltage is of sufficient strength to result in the electrical breakdown of the insulation in the control windings, resulting in the catastrophic failure of the variable inductor. This effect can significantly limit the power handling capability in such applications.

In accordance with the present approach, there is provided a variable inductor which avoids electrical breakdown of the insulation in the control windings when used in high power applications. In one embodiment, the inductor includes a core formed of a permeable magnetic material, the core having three legs, including a center leg and two outer legs. The variable inductor further includes a main winding element comprising a main conductor wound around the center leg of the core and a control winding element comprising a control conductor wound in a figure-eight configuration having a first winding and a second winding around respective outer legs. The winding configuration cancels induced voltages in the first and second windings, wherein a current through the control winding element causes a change in inductance of the main winding element.

Various configurations of the variable inductor are contemplated by the present approach. In one embodiment, the variable inductor can include multiple cores magnetically coupled in series with each other. In another embodiment, the variable inductor can include an i-core magnetically coupled across the center leg and two outer legs of the core.

In another embodiment, the variable inductor can include an air gap provided in the center leg of the core. A non-magnetic spacer can be inserted in the air gap. In another embodiment, the main conductor and/or the control conductor can be made from Litz wire.

In another embodiment, the variable inductor can include a main core formed of a permeable magnetic material, the main core having three legs, including a center leg and two outer legs, a control core formed of a permeable magnetic material, the control core having three legs, including a center leg and two outer legs. The legs of the main core oppose the legs of the control core to provide a magnetic coupling between the legs. A main winding element comprising a main conductor is wound around the center leg of the main core and a control winding element comprising a control conductor is wound in a figure-eight configuration having a first winding and a second winding around respective outer legs of the control core. The winding configuration cancels induced voltages in the first and second windings, wherein a current through the control winding element causes a change in inductance of the main winding element.

The variable inductor can include multiple main cores magnetically coupled in series, and multiple control cores magnetically coupled in series. The legs of respective main cores oppose the legs of respective control cores to provide a magnetic coupling between the legs.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A description of preferred embodiments of the invention follows.

An ultrasonic continuous processing system is described in detail in United States Patent Publication 2002/0121785, the entire teachings of which are herein incorporated by reference. Generally, the system comprises a processing chamber having an outer wall and an inner wall, the inner wall defining a volume of the processing chamber. The outer wall of the chamber can be constructed of glass, metal, or other suitable material with a piezoelectric actuator mounted on the outer wall. The chamber can be filled with a gas, fluid, or slurry. The piezoelectric actuator (a capacitive element) when coupled with an inductive element forms a series resonant tank circuit.

In operation, the series resonant tank circuit of 2002/0121785 can be electrically driven via an oscillator to produce an acoustical wave front within the processing chamber when operated at or near resonant frequency of the container walls. It was observed that the resonant tank circuit could be initially configured to produce a power factor near unity. However, during operation of the processing system, the power factor dropped and the energy efficiency declined because operating conditions of the system components changed. These changes caused component parameter variations which included but were not limited to fluctuations in output frequency of the oscillator; changes in fluid pressure on the chamber walls; and temperature dependent changes in the piezoelectric film, the series inductor and the electrical driver circuit. These changes in system parameters also resulted in a reduction of the power factor and the loss of system efficiency.

It became apparent that a control device would be required to maintain a unity power factor while changes occurred in the operating conditions of the ultrasonic processing system. Electrically efficient operation of the resonant circuit occurs when the voltage and current are in phase. When this situation occurs, the circuit is said to have a power factor of unity. A series resonance circuit is produced by a connection of an inductor with a current lag relationship compared to an applied voltage to a capacitor that behaves as a current lead device. When the capacitor and the inductor are out of balance there is a net lag or lead between the phase relationship of the applied voltage to the current in the resonant circuit. This situation is said to have a power factor of less than unity.

Figure 1:
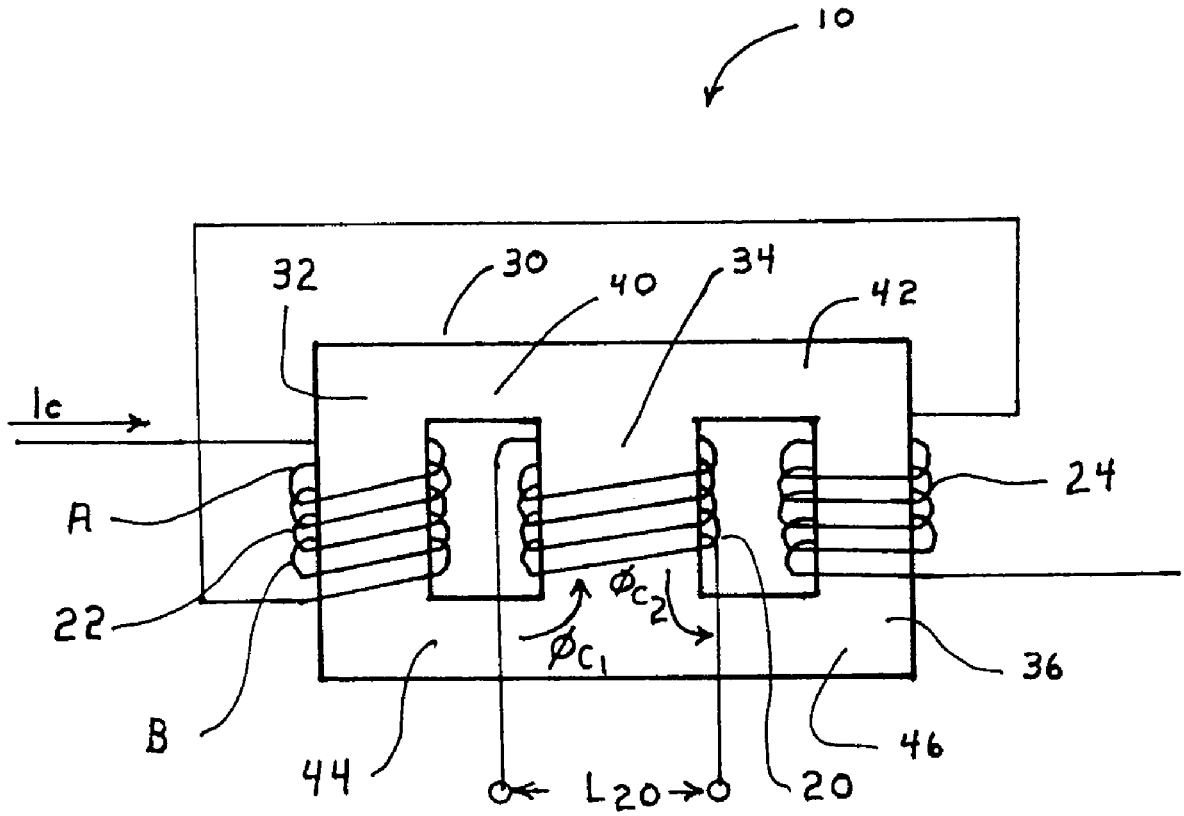
FIG. 1 (PRIOR ART)
FIG. 1 shows a variable inductor according to the prior art.
Figure 2A:
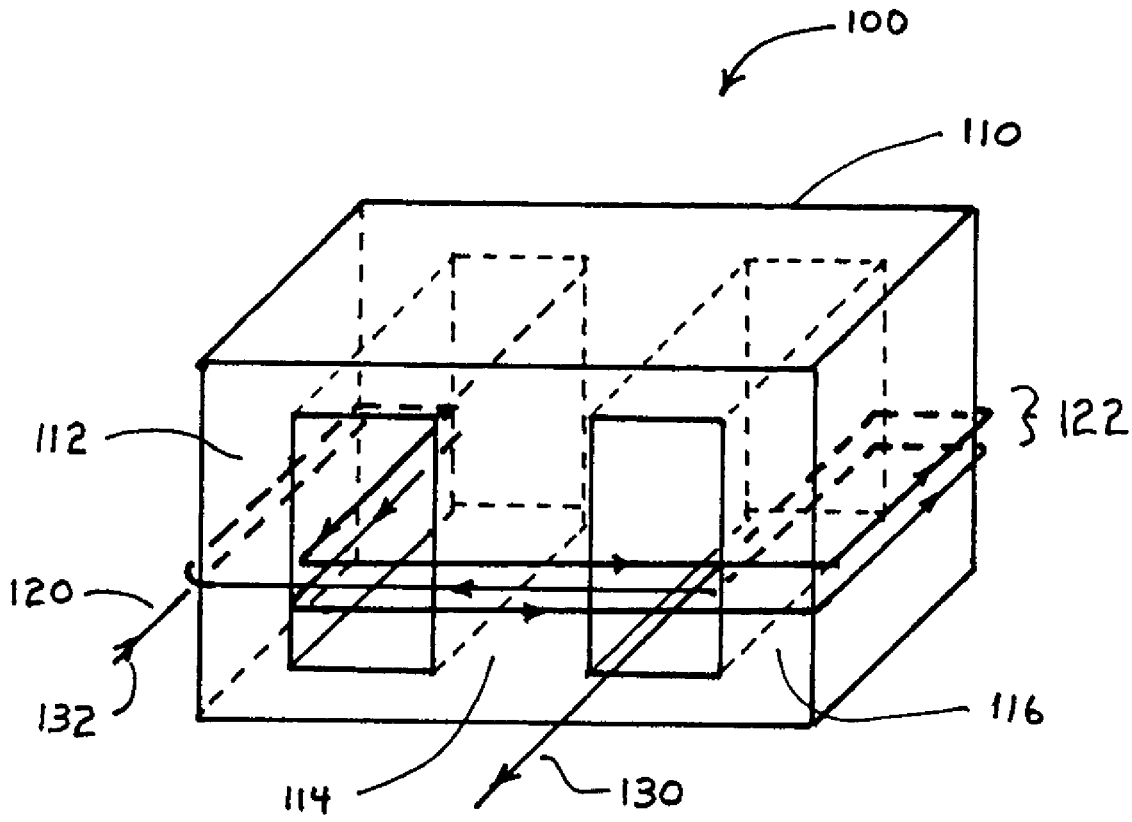
FIG. 2A shows a perspective view of outer legs of a variable inductor according to the principles of the present invention.
Figure 2B:
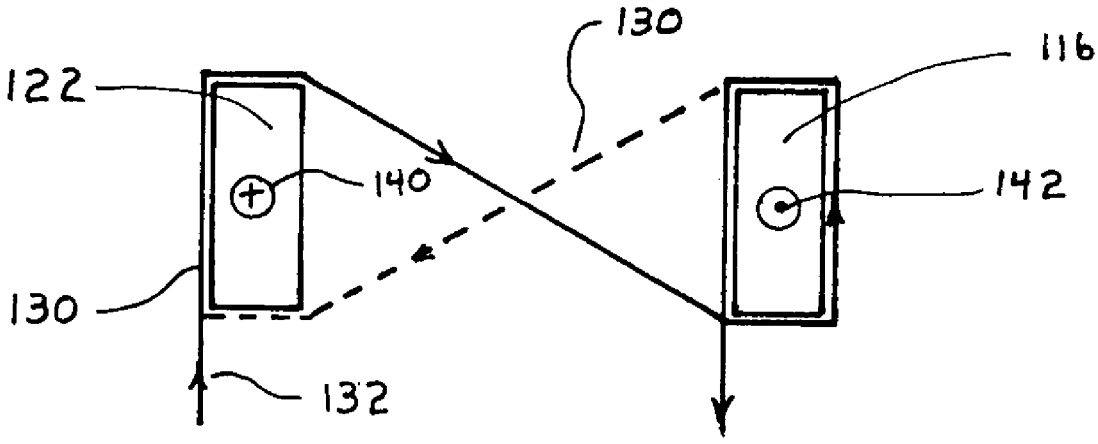
FIG. 2B shows a cross-sectional view of outer legs of the variable inductor of FIG. 2A.

The present invention provides an electrically controlled variable inductor that is suitable for use, for example, as a control device in high magnetic flux (high power), high Q factor (minimal loss), series resonant tank circuits. FIGS. 2A and 2B show a variable inductor 100 according to the principles of the present invention. For illustration purposes only, a main winding about the center leg is not shown in FIG. 2A and the center leg of the magnetic core is not shown in FIG. 2B. A magnetic core 110 is shown consisting of a magnetic material which can be saturated, having three legs 112, 114 and 116. Control windings 120, 122 are formed simultaneously on legs 112 and 116 respectively by winding an insulated control conductor in a figure-eight configuration as shown in FIG. 2B. One revolution around legs 112 and 116 is equal to one-turn (N) of the control windings 120, 122. This step is repeated until a desired number of (N) turns are completed. Typically, several hundred to several thousand turns are used to create the variable inductor 100.

The control conductor can be made from Litz wire. Litz wire consists of a number of insulated strands of individual wires twisted together and electrically connected to each other only at the ends. The use of Litz wire provides a current load capacity to carry the load through the inductor 100. However, because the wires are insulated from each other they do not have the effective Eddy current losses of a single large wire, or multiple strands of non-insulated wires, that will have greater losses in an alternating magnetic field.

FIG. 2B shows the resulting current flow in the conductor 130 as denoted by current arrow 132. The current flow creates an opposing magnetic flux Φ in each leg 112 and 116 as denoted by symbols 140, 142 respectively. One skilled in the art should understand that if current flowed in the opposite direction from that shown, the resulting magnetic flux Φ would also reverse direction. The figure-eight configuration allows for a turn-by-turn cancellation of induced voltages, i.e. zero volts on the control windings 120, 122 when an AC voltage is applied to the main winding (not shown). That is, each successive one-half of a coil turn of the winding has an induced voltage, due to the main winding, in the opposite polarity from its paired half. The induced inter winding voltage between any two loops on a respective leg is also near zero volts. It should be understood by one skilled in the art that the figure-eight configuration can be accomplished by taking a flat wound coil and giving it a 180 degree twist.

Figure 3A:
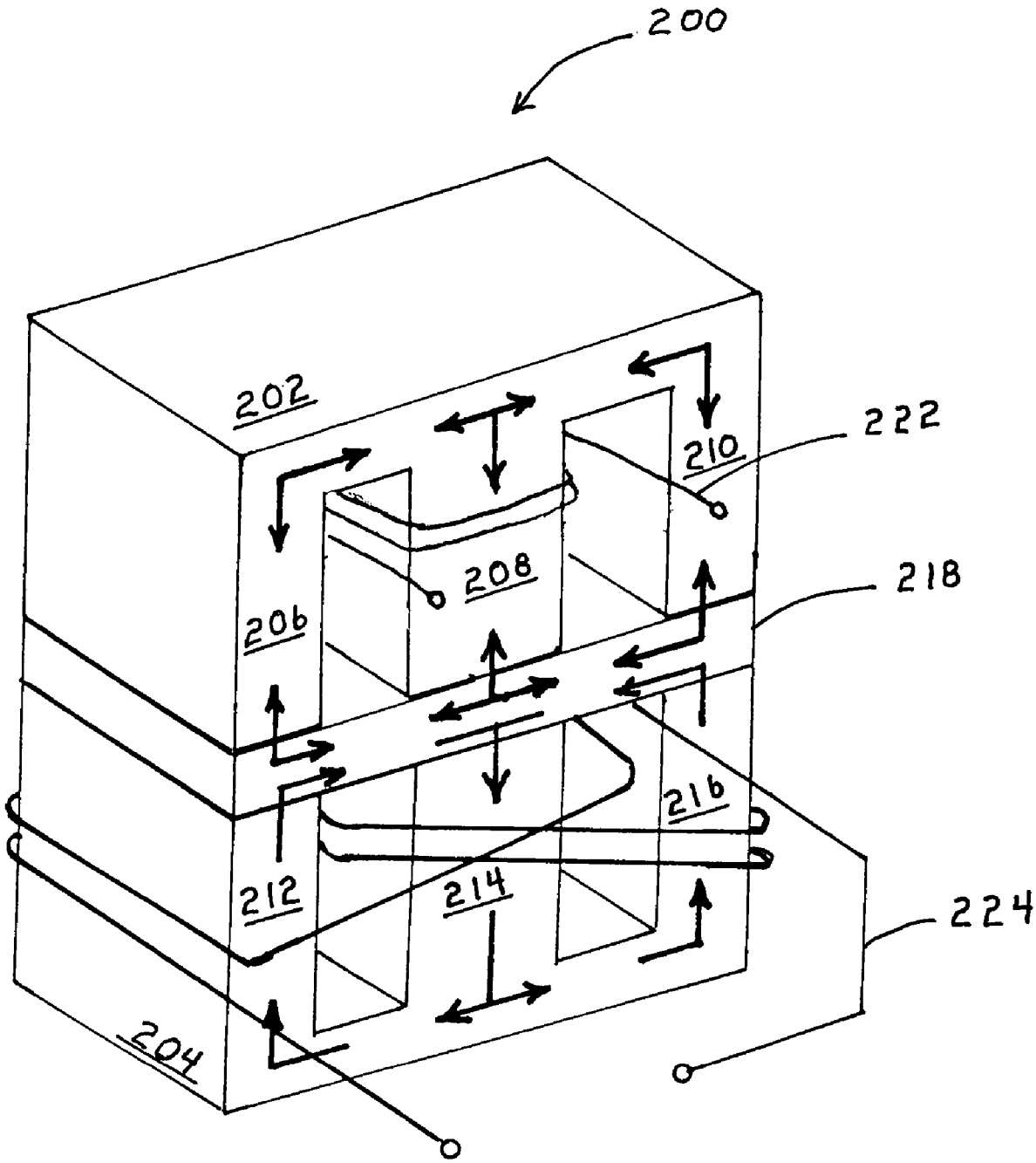
FIG. 3A shows a perspective view of another embodiment of the invention.
Figure 3B:
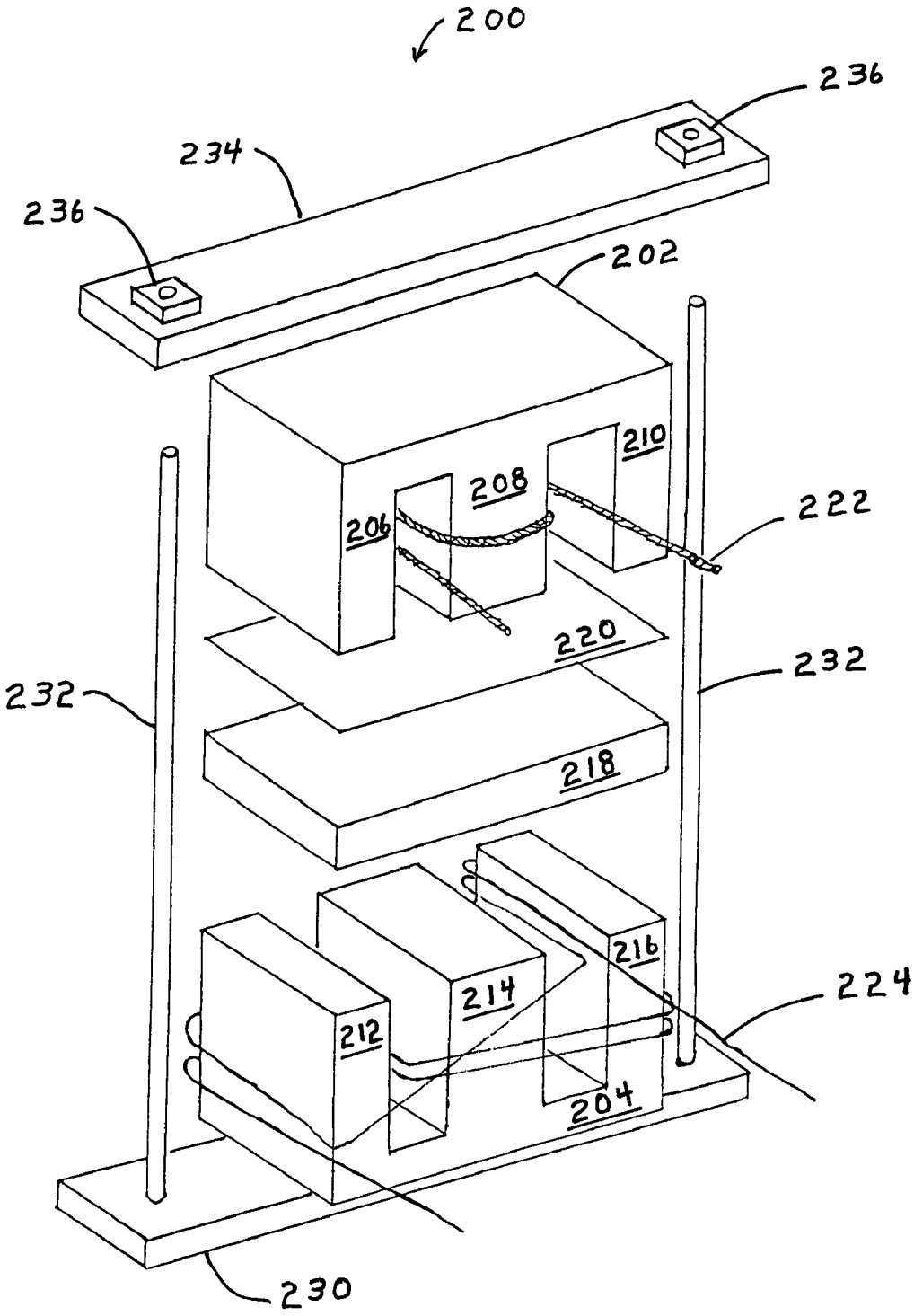
FIG. 3B shows an exploded view of the embodiment of FIG. 3A.

FIGS. 3A and 3B show another embodiment of the present invention. A variable inductor 200 includes a main magnetic e-core 202 and a control magnetic e-core 204. Main e-core 202 includes three legs 206, 208, 210 and control e-core 204 includes legs 212, 214, 216. A magnetic shunt bar or i-core 218 is magnetically coupled to legs 212, 214, 216 of e-core 204. A non-magnetic spacer 220 is coupled between the i-core 218 and legs 206, 208, 210 of e-core 202. The spacer 220 provides an air gap to reduce the permeability and inductance in the inductor 200, thereby increasing the magnetizing current in the main winding 222. Optionally, the air gap can be provided by shortening the leg 208 by grinding or any other known means. A main winding 222 is wound around the leg 208 of e-core 202. A control winding 224 is wound around legs 212, 216 of e-core 204 in a figure-eight configuration as described above. The e-cores 202, 206, i-core 218, and spacer 220 can be mechanically coupled using a compression assembly consisting of a bottom bar 230, threaded-rods 232, top bar 234 and lock down nuts 236, although it should be understood by one skilled in the art that any suitable means may be used to couple these elements.

The magnetic shunt bar 218 includes a smooth surface in contact with the surfaces of the legs 212, 214, 216 of the control core 204. The magnetic shunt bar 218 can be notched to accommodate the threaded rods 232 in the compression assembly. The notches assist in the alignment of the magnetic shunt bar 218. The voltage applied to the control winding 224 attracts the magnetic shunt bar 218 and controls the magnetic flux density and related permeability within the magnetic shunt bar 218, thereby reducing or increasing the effective permeability of the main e-core 202.

Figure 4B:
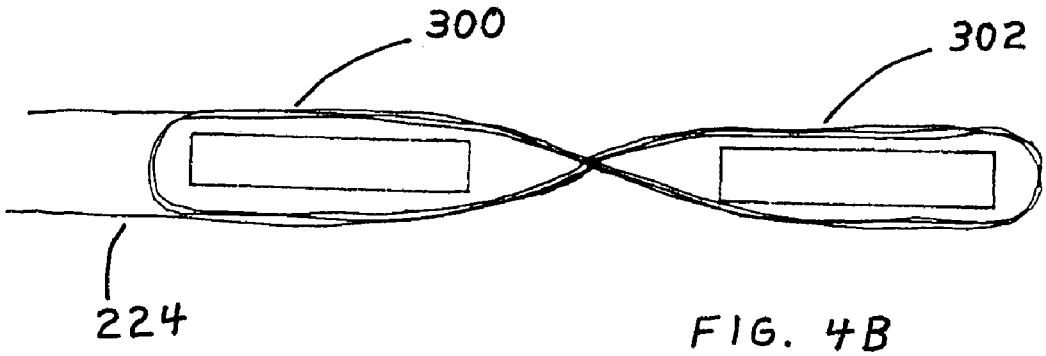
FIG. 4B shows a top view of the control winding of FIG. 4A.
Figure 4A:
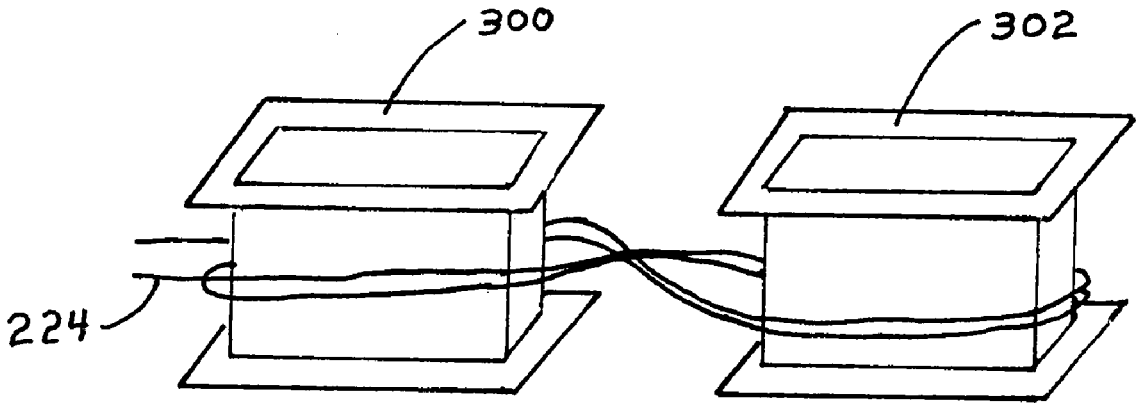
FIG. 4A shows a perspective view of a control winding wound in a yoke configuration on bobbins.
Figure 4C:
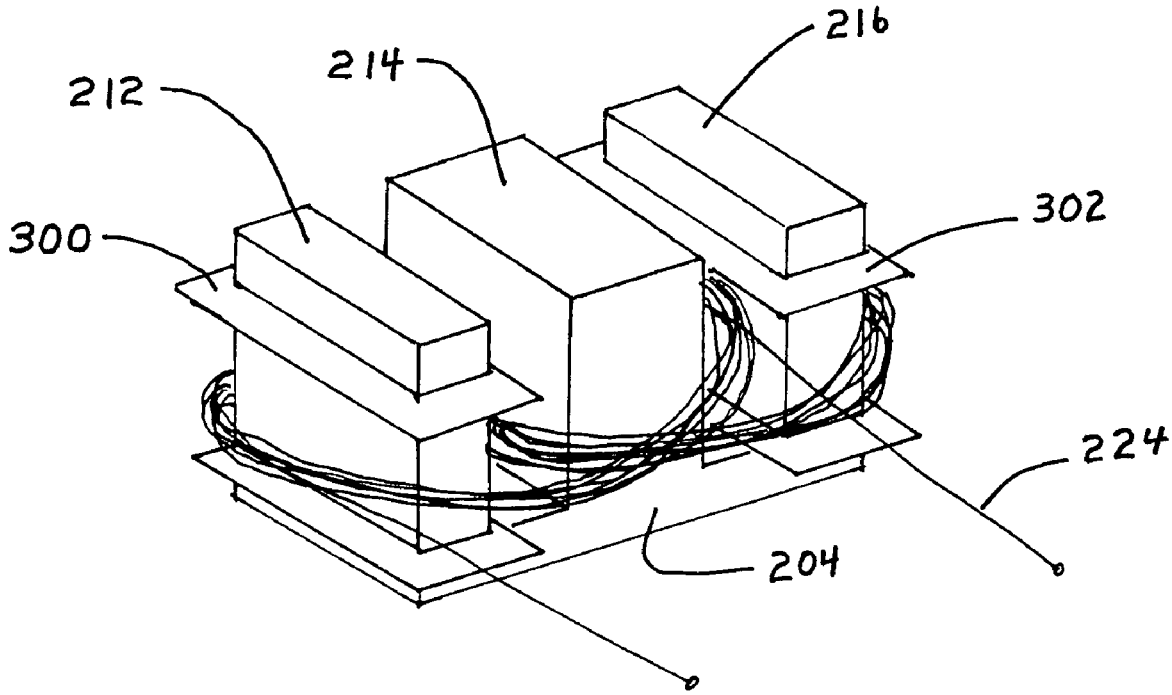
FIG. 4C shows a perspective view of the control winding positioned on a magnetic e-core.

FIG. 4A-4C show a technique for forming control winding 224. The control winding 224 can be formed on a bobbins 300, 302 as described above. Once formed, the control coil 224 and bobbins 300, 302 can be place over legs 212, 216 of the control core 204. The control coil 224 can be held in place by an insulated wire wrapping device, such as tie-wraps, string, or any other suitable device known in the art.

Figure 5:
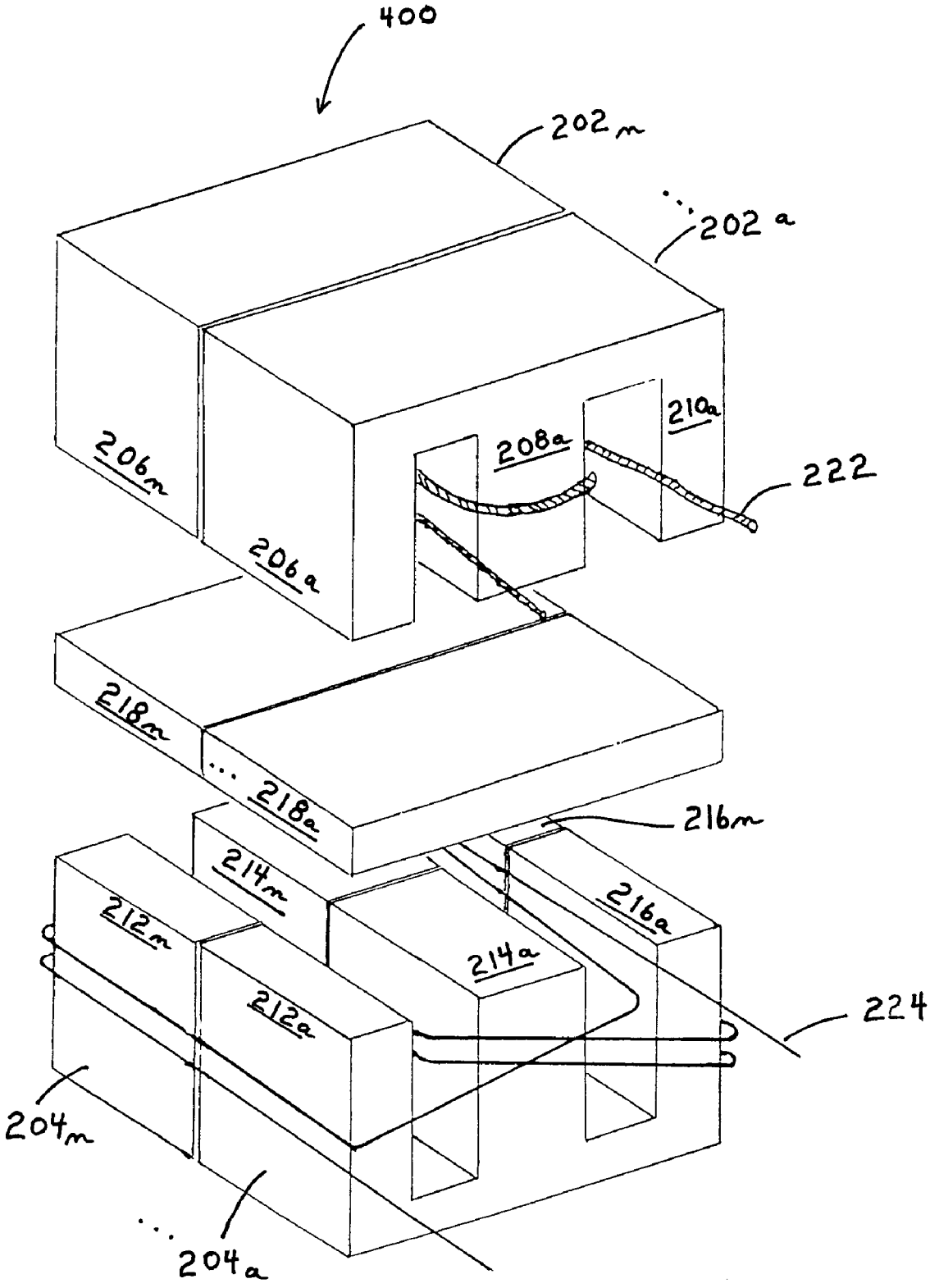
FIG. 5 shows a perspective view of another embodiment of the invention including multiple magnetic e-cores.

FIG. 5 shows another embodiment of a variable inductor 400 including multiple main cores 202*a* . . . 202*n* and multiple control cores 204*a* . . . 204*n*. Optional magnetic shunt bar 218*a* . . . 218*n* and non-magnetic spacers may be used. A main winding 222 is wound around the legs 208*a* . . . 208*n* of main e-cores 202*a* . . . 202*n*. A control winding 224 is wound around legs 212*a* . . . 212*n*, 216*a* . . . 216*n* of control e-cores 204*a* . . . 204*n* in a figure-eight configuration as described above.

Figure 6:
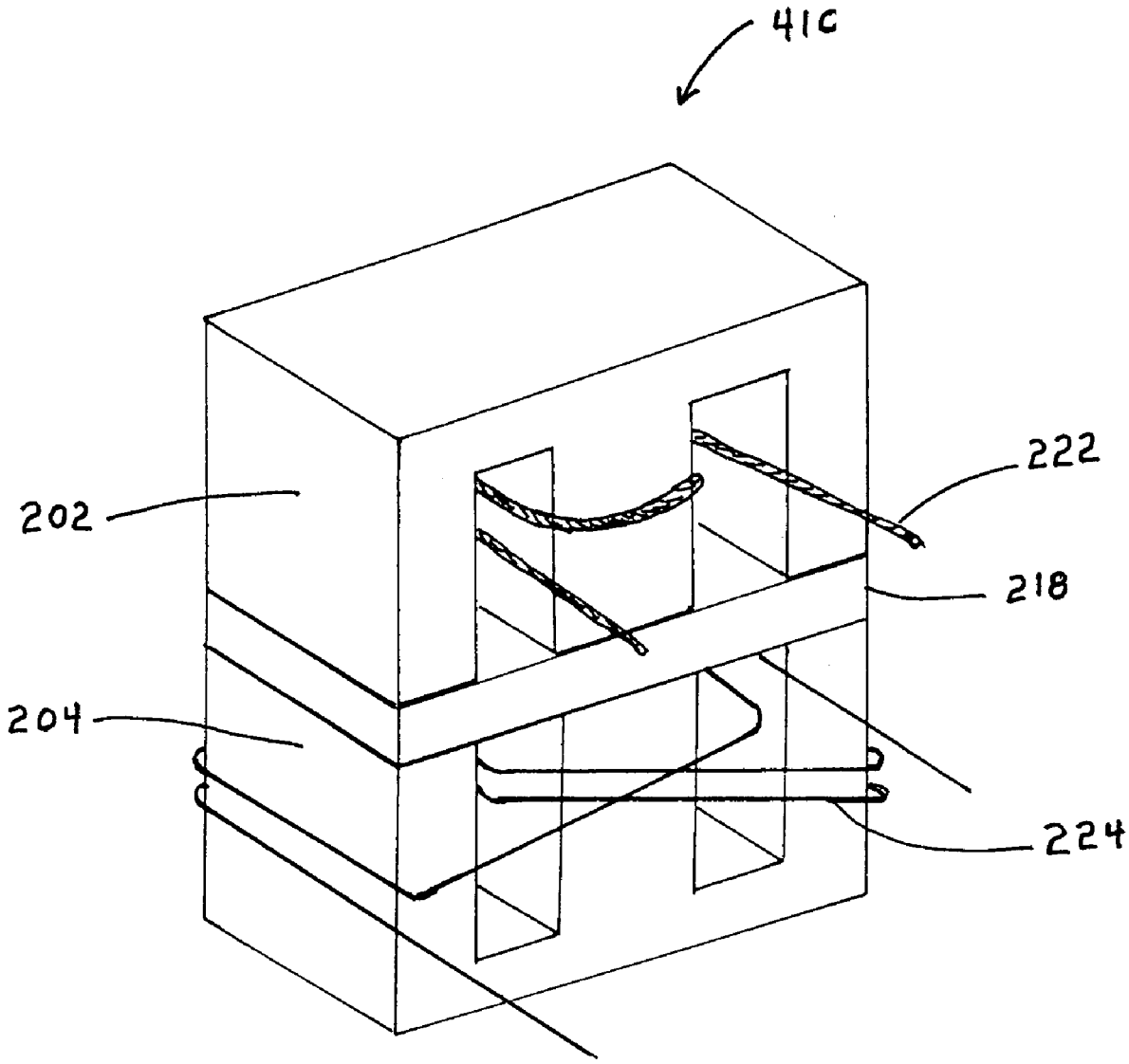
FIG. 6 shows a perspective view of another embodiment of the invention.

FIG. 6 shows another embodiment of a variable inductor 410 according to the principle invention. The variable inductor 410 is similar to inductor 200 of FIG. 3A and 3B but without the non-magnetic spacer 220.

Figure 7:
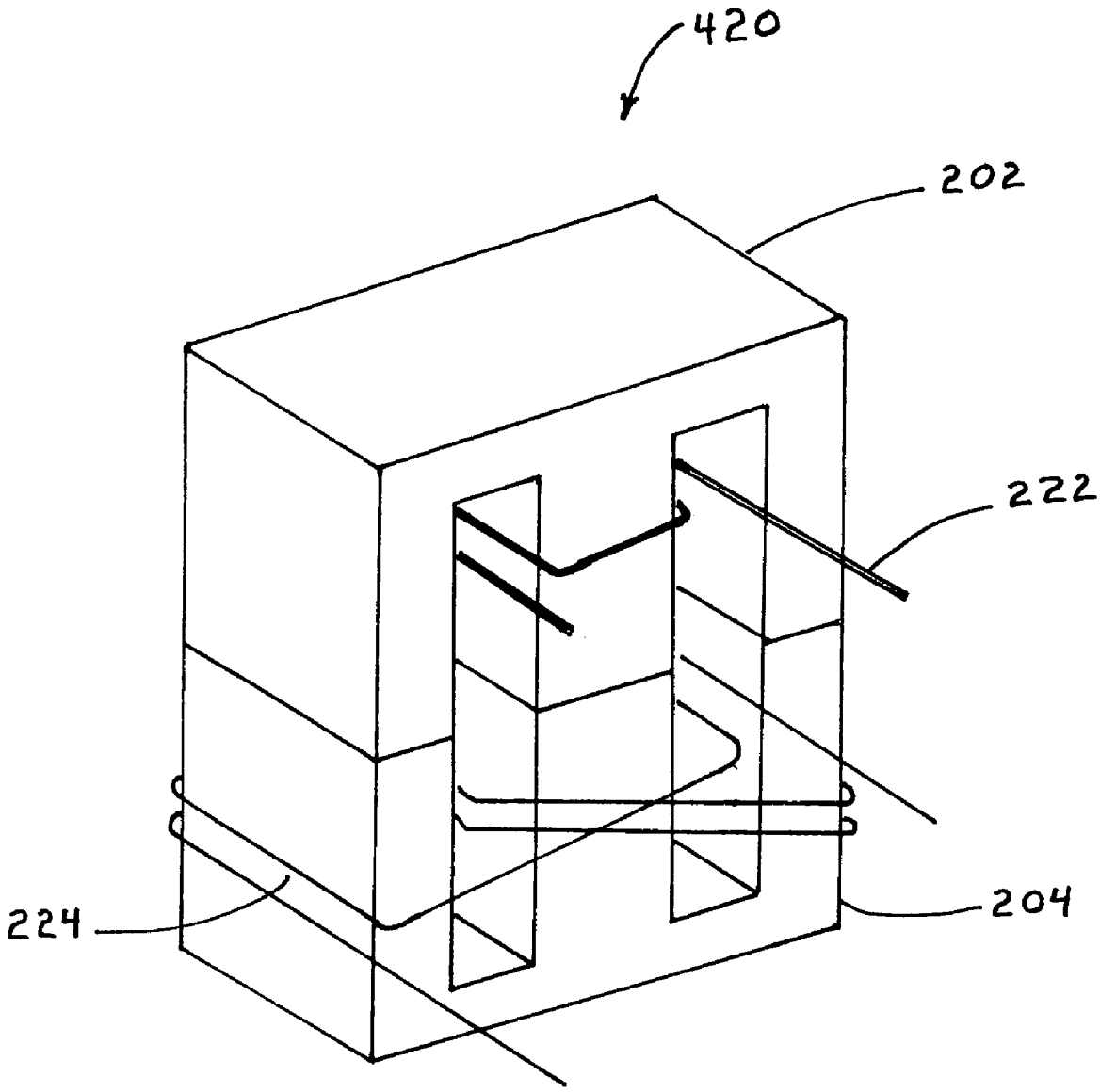
FIG. 7 shows a perspective view of another embodiment of the invention.

FIG. 7 shows another embodiment of a variable inductor 420 according to the principle invention. The variable inductor 420 is similar to inductor 200 of FIGS. 3A and 3B without the non-magnetic spacer 220 and without the magnetic shunt bar 218.

It should be understood that embodiments can be provided with or without a non-magnetic spacer, with or without a magnetic shunt bar, and with or without multiple e-cores.

While this invention has been particularly shown and described with references to preferred embodiments thereof, it will be understood by those skilled in the art that various changes in form and details may be made therein without departing from the scope of the invention encompassed by the appended claims.

What is claimed is:

1. A variable inductor, comprising:

a core element formed of a permeable magnetic material, the core element having three legs, including a center leg and two outer legs;

a main winding element comprising a main conductor wound around the center leg; and a control winding element comprising a control conductor wound in a turn-by-turn figure-eight configuration having a first winding and a second winding around respective outer legs, the winding configuration canceling turn-by-turn induced voltages in the first and second windings, wherein a current through the control winding element causes a change in inductance of the main winding element.

2. The variable inductor of claim 1, wherein the core element comprises multiple cores, each core formed of a permeable magnetic material, each core magnetically coupled in series, each core having three legs, including a center leg and two outer legs.

3. The variable inductor of claim 1, further comprising an i-core formed of a permeable magnetic material, the i-core magnetically coupled across the center leg and two outer legs of the core element.

4. The variable inductor of claim 1, wherein the center leg of the core element has an air gap.

5. The variable inductor of claim 4, wherein a non-magnetic spacer is disposed in the air gap.

6. The variable inductor of claim 1, wherein the main conductor is Litz wire.

7. The variable inductor of claim 1, wherein the control conductor is Litz wire.

8. The variable inductor of claim 1, wherein the figure-eight configuration is an n-turn coil having a 180 degree twist.

9. A variable inductor, comprising:

a main core element formed of a permeable magnetic material, the main core element having three legs, including a center leg and two outer legs;

a control core element formed of a permeable magnetic material, the control core element having three legs, including a center leg and two outer legs; the legs of the main core opposing the legs of the control core to provide a magnetic coupling between the legs; a main winding element comprising a main conductor wound around the center leg of the main core; and a control winding element comprising a control conductor wound in a turn-by-turn figure-eight configuration having a first winding and a second winding around respective outer legs of the control core, the winding configuration canceling turn-by-turn induced voltages in the first and second windings, wherein a current through the control winding element causes a change in inductance of the main winding element.

10. The variable inductor of claim 9, wherein the main core element comprises multiple main cores, each main core formed of a permeable magnetic material, each main core magnetically coupled in series, each main core having three legs, including a center leg and two outer legs; and wherein the control core element comprises multiple control cores, each control core formed of a permeable magnetic material, each control core magnetically coupled in series, each core control having three legs, including a center leg and two outer legs, the legs of respective main cores opposing the legs of respective control cores to provide a magnetic coupling between the legs.

11. The variable inductor of claim 9, further comprising an i-core, the i-core formed of a permeable magnetic material, the i-core magnetically coupled between and across the legs of the main core element and the control core element.

12. The variable inductor of claim 11, further comprising a non-magnetic spacer coupled between the i-core and the main core element to provide an air gap.

13. The variable inductor of claim 9, wherein the center leg of the main core element is shorter in length than the outer legs of the main core element.

14. The variable inductor of claim 9, wherein the main conductor is Litz wire.

15. The variable inductor of claim 9, wherein the control conductor is Litz wire.

16. The variable inductor of claim 9, wherein the figure-eight configuration is an n-turn coil having a 180 degree twist.

17. The variable inductor of claim 1, wherein the turn-by-turn cancellation of the induced voltages in the first and second windings allows the variable inductor to operate in a high magnetic flux region.

18. The variable inductor of claim 9, wherein the turn-by-turn cancellation of the induced voltages in the first and second windings allows the variable inductor to operate in a high magnetic flux region.

* * * * *